US005117925A

United States Patent [19]

White

[11] Patent Number: 5,117,925

[45] Date of Patent: Jun. 2, 1992

[54] SHOCK ABSORBING APPARATUS AND METHOD FOR A VIBRATORY PILE DRIVING MACHINE

[76] Inventor: John L. White, 2112 S. 277th Pl., Federal Way, Wash. 98023

[21] Appl. No.: 465,464

[22] Filed: Jan. 16, 1990

Related U.S. Application Data

[63] Continuation-in-part of Ser. No. 464,429, Jan. 12, 1990, abandoned.

[51] Int. Cl.[5] ..... E02D 7/18; E21B 7/24

[52] U.S. Cl. ..... 173/162.1; 173/49; 175/56; 405/232

[58] Field of Search ..... 173/49, 162.1; 175/56; 405/232

[56] References Cited

U.S. PATENT DOCUMENTS

| | | | |
|---|---|---|---|
| 2,439,219 | 4/1948 | O'Connor | 173/162.1 |
| 2,760,747 | 8/1956 | Mordarski | 248/358 |
| 2,975,846 | 3/1961 | Bodine, Jr. | 175/56 |
| 3,808,820 | 5/1974 | Bodine | 175/56 |
| 3,828,864 | 8/1974 | Haverkamp et al. | 173/162.1 |
| 3,865,501 | 2/1975 | Kniep | 175/56 |
| 3,909,149 | 9/1975 | Century | 404/133 |
| 4,274,761 | 6/1981 | Boguth | 173/162.1 |
| 4,522,304 | 6/1985 | Dean, II | 206/591 |
| 4,606,427 | 8/1986 | Beer | 180/300 |
| 4,645,017 | 2/1987 | Bodine | 173/162.1 |
| 4,819,740 | 4/1989 | Warrington | 173/49 |

*Primary Examiner*—Hien H. Phan
*Attorney, Agent, or Firm*—Hughes & Multer

[57] ABSTRACT

A shock absorbing apparatus for a vibratory pile driving/pulling device having a base section connected to a vibrating device, a connecting section connected to a carrying member such as a lifting cable and an intermediate section operatively connecting the base section and the connecting section. First shock absorbing members are provided for resisting force of relatively small magnitude between the base section and the intermediate section and second shock absorbing members are provided for resisting force of relatively greater magnitude between the intermediate section and the connecting section. A limit stop is provided to limit the relative vertical displacement between the base section and the intermediate section such that the second shock absorbing members absorb much of the load when the apparatus is under a substantial external load.

9 Claims, 3 Drawing Sheets

SHOCK ABSORBING APPARATUS AND METHOD FOR A VIBRATORY PILE DRIVING MACHINE

CROSS-REFERENCE TO RELATED CASE

This patent application is a continuation-in-part application of a patent application filed Jan. 12, 1990 Ser. No. 07/464,429, entitled "Shock Absorbing Apparatus and Method for a Vibratory Pile Driving Machine" by John L. White, now abandoned.

BACKGROUND OF THE INVENTION

A) Field of the Invention

The present invention relates to a shock absorbing apparatus and method to be used in conjunction with a pile driving and/or pile pulling vibratory machine, and more particularly to such an apparatus and method which can be used effectively to isolate shocks under greatly varying load conditions imparted to the shock absorbing apparatus.

B) Background of the Invention

In the construction industry, it is sometimes necessary to drive piles into the earth to provide a proper foundation for a building or other structure. One method of accomplishing this is to place the pile in a vertical position above the earth's surface and strike the upper end of the pile repeatedly with a hammer (i.e., a metal mass which is raised and dropped on the pile) until the pile has penetrated into the ground surface a sufficient distance to provide adequate bearing. A later development was to drive piles into the ground by use of a vibrating machine which oscillates the pile from zero to 20,000 cycles per minute depending on the type of machine to cause what appears to be an almost continuous motion of the pile into the earth. Under some circumstances, such a vibratory machine can cause the pile to move into the earth relatively rapidly (e.g., as fast as ten feet per second).

A typical arrangement for such a vibratory machine is to provide a pair of weights which are mounted eccentrically for rotation about parallel axes, with the directions of rotation being opposite to one another so that the lateral forces are cancelled out, and a net up and down vibrating force is developed by the machine. One part of the machine is coupled to the upper end of the pile, while a second part of the machine is connected through a shock absorbing device to a support member, such as a cable.

When the pile is being driven into the ground, the vibratory machine is able, in large part, to act substantially independently, in that only minimal exterior support is required, this being mainly to keep the vibratory machine properly positioned. Sometimes weights are added to the shock absorbing device to provide a greater downward force, and this gives greater need for effective shock absorption. Another mode of operation is when a previously driven pile is being extracted from the earth, and it is necessary to impart a tension force on the pile so as to pull it upwardly. In these circumstances, a tension force (e.g., a pulling force exerted by a connecting cable) is applied through the shock absorbing device to the vibratory machine, which in turn pulls upwardly on the pile to which it is connected. The tension force exerted by the cable can vary greatly, and can vary between two tons to one hundred tons.

For various reasons, it is desirable that the cable be subjected to a more constant load, with the rapid vibratory loads being isolated from the cable as much as possible. However, properly isolating these vibratory loads is complicated by the fact that the tension loads necessary to extract the pile can vary greatly, depending upon the size of the pile, the depth to which it is driven, and the localized resisting forces imparted by various portions of the earth material.

SUMMARY OF THE INVENTION

The present invention comprises a shock absorbing apparatus adapted to be connected to a pile driving and/or pile pulling vibratory device which imparts a vibrating force to a pile.

This shock absorbing apparatus comprises a base section which is adapted to be connected to the vibratory device. There is also a connecting section adapted to be connected to a carrying member, such as a lifting cable which can apply a tension load. There is also an intermediate section which is operatively connected between the base section and the connecting section. There is a first shock absorbing means operatively connected between the base section and the intermediate section to yieldingly resist vibratory motion between the base section and the intermediate section. This first shock absorbing means yieldingly resists such motion with a resisting force of a relatively smaller magnitude.

There is a second shock absorbing means operatively connected between the intermediate section and the connecting section to resist vertical vibratory motion therebetween. This second shock absorbing means provides a resisting force of a relatively greater magnitude.

Accordingly, when a relatively smaller external force is applied to the base section and the connecting section to urge these components to be displaced from one another, vibratory motion imposed on the apparatus is absorbed largely in the first shock absorbing means. However, under a substantially increased load, most of the shock of the vibratory loads is absorbed in the second shock absorbing means.

In the preferred form, there are stop limit means to limit relative vertical movement between the base section and the intermediate section, so that under a substantial external load, the base section is in direct bearing engagement with the connecting section so that the shock absorbing loads are substantially absorbed in the second shock absorbing means.

Other features will become apparent from the following detailed description.

DESCRIPTION OF THE PREFERRED EMBODIMENT

Figure 1:
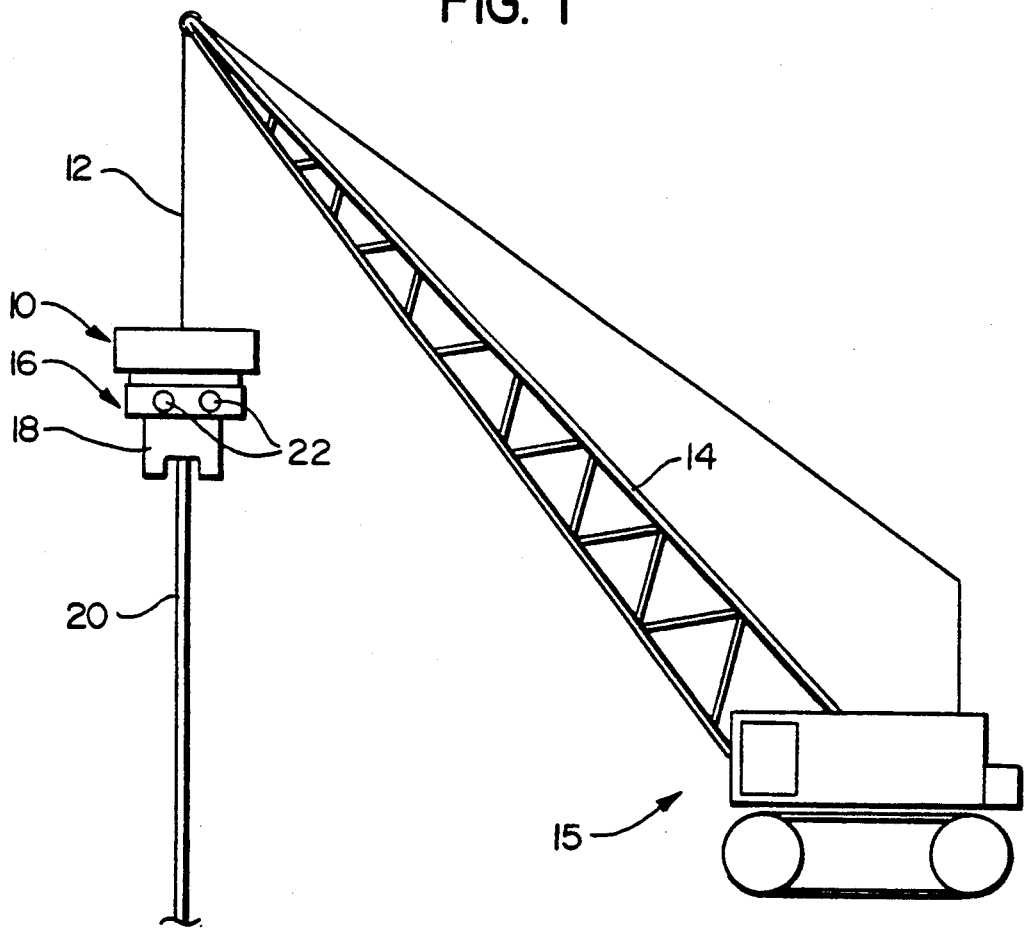
FIG. 1 is a side elevational view, showing the shock absorbing apparatus of the present invention somewhat schematically in its operating environment where it is suspended from a crane and connected to a vibratory machine engaging a pile.

With reference to FIG. 1, the shock absorbing apparatus 10 of the present invention is shown connected to a cable 12 which is in turn carried by a boom 14 of a crane 15. The shock absorbing apparatus is connected on its lower side to a vibratory machine 16 which has a jaw mechanism 18 that grips the upper end of a pile 20. This vibrating machine 16 is or may be of conventional design, and there is shown schematically a pair of eccentrically mounted weights 22 which rotate about parallel axes in opposite directions so as to cause a net up and down vibrating force.

As indicated previously, when the pile 20 is being driven, there may be little, if any, tension placed on the cable 12. However, if the pile 20 is being pulled out of the earth, then it may be necessary to exert a quite substantial tension force on the cable 12 (e.g., as high as two tons to one hundred tons), while the vibrating machine 16 imparts the vibrating force to the pile 20. Under these circumstances (i.e., when the pile 20 is being pulled from the earth), it is particularly desirable that the shock absorbing apparatus 10 isolate the cable 12 (and consequently the boom 14 and crane 15) from the vibratory forces.

Figure 2:
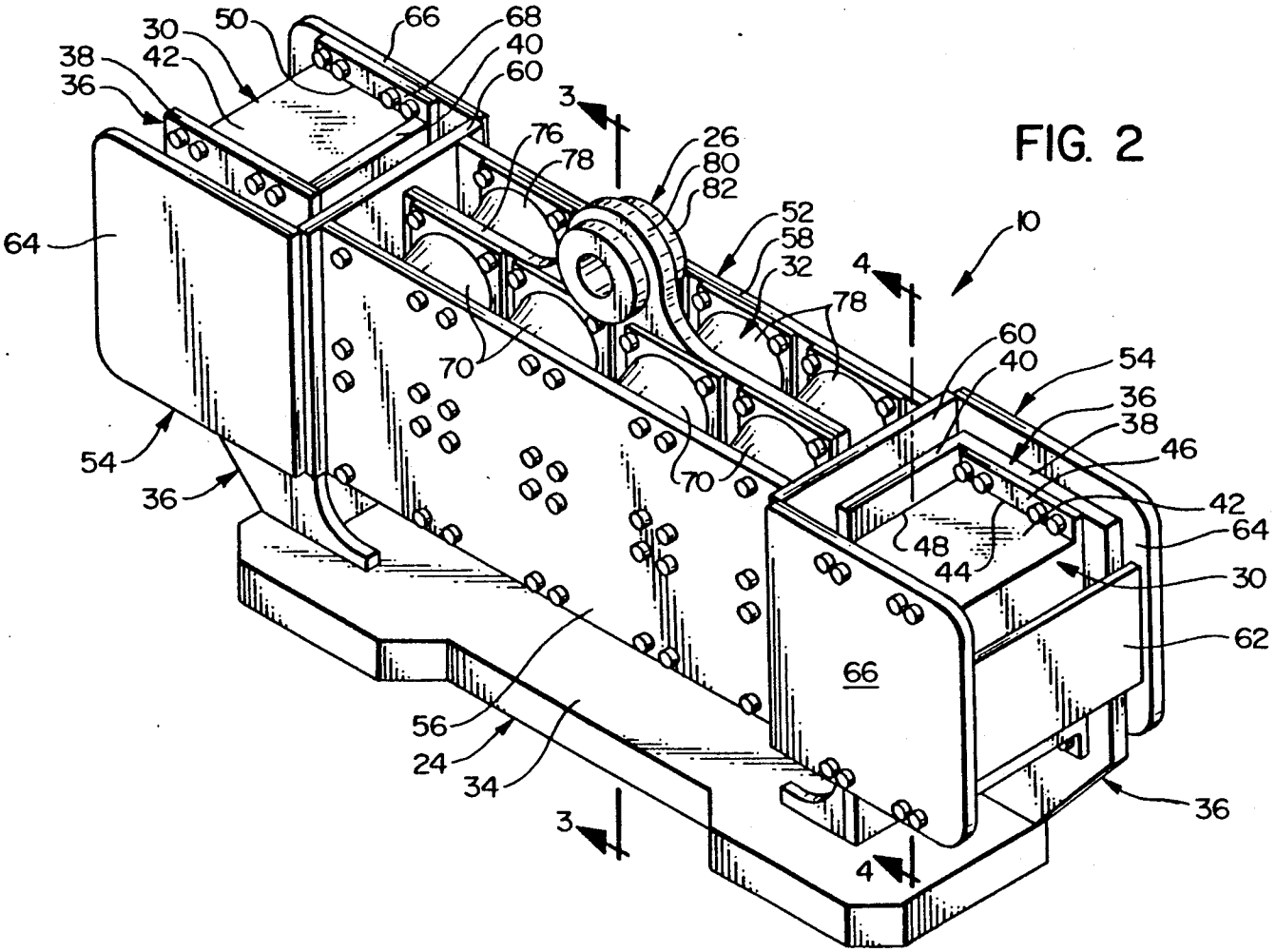
FIG. 2 is an isometric view of the shock absorbing apparatus of the present invention.
Figure 3:
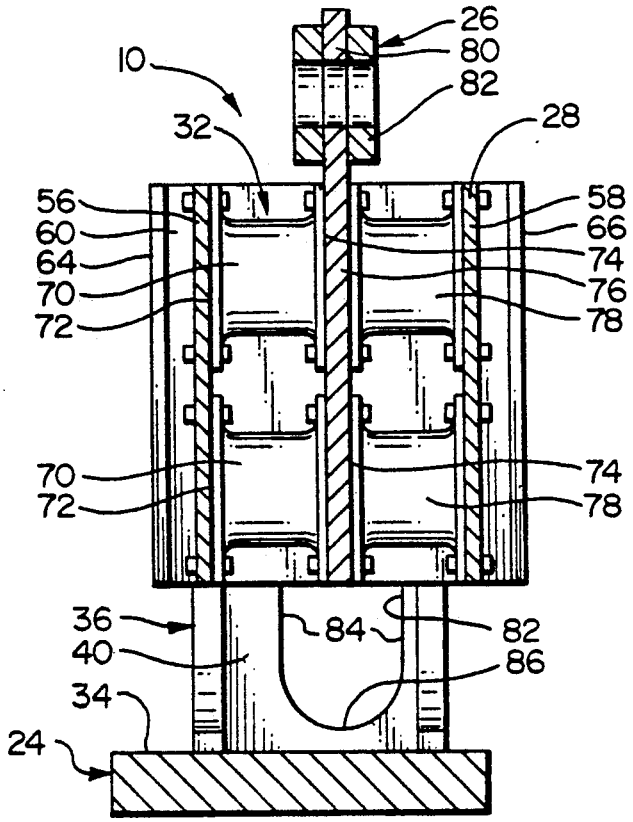
FIG. 3 is a sectional view taken along line 3—3 of FIG. 2.

With reference to FIG. 2, in terms of function, the apparatus 10 can be considered as comprising five main components: namely, (a) a base section 24 by which the apparatus 10 is connected to the vibratory machine 16, (b) a connecting section 26 by which the apparatus 10 is connected to the cable 12 or other connecting device, (c) an intermediate section 28, (d) a first shock absorbing means 30 which is operatively connected between the base section 24 and the intermediate section 28, and (e) a second shock absorbing means 32 operatively connected between the intermediate section 28 and the connecting section 26.

The vibratory forces from the machine 16 are imparted directly into the base section 24. The first shocking absorbing means 30 is more yielding and will perform a more significant shock absorbing function under lower load conditions, while the second shock absorbing means 32 is arranged to have the primary function of absorbing the shock loads when the loading is at a substantially higher level. In following description, the structure of each of the five main components 24–32 will be described in detail, after which there will be a summary of the mode of operation.

The base section 24 comprises a main horizontally disposed base plate 34 which can be attached directly to the vibratory machine 16. Two base shock mounting structures 36 are fixedly attached to the base plate 34 at opposite ends thereof.

For purposes of description, the apparatus 10 will be considered as having a longitudinal axis which extends in a lengthwise direction from one shocking mounting structure 36 to the other, and a transverse axis perpendicular to the longitudinal axis. The vertical axis will be perpendicular to these other two axis. The term "front" will be used to denote that side of the apparatus 10 which appears nearer to the viewer in FIG. 2, while the term "rear" denotes an opposite side or direction. The term "inner" or "inward" will be used to denote a location closer to the vertical center axis of the apparatus 10, while the terms "outer" or "outward" will denote a location further away from that center axis.

Each shock mounting structure 36 comprises a vertically and longitudinally aligned side plate 38 and a vertically and transversely aligned gusset plate 40 fixedly attached thereto. The lower edges of these two plates 38 and 40 are fixedly connected to the upper surface of the base plate 34.

The first shock absorbing means 30 comprises two main first shock absorbers 42, each of which is made of a rubber like shock absorbing material and has the configuration of a large rectangular prism. The term "front" will be used to denote that portion of the apparatus 10 which appears nearer to the viewer in FIG. 2, while the term "rear" denotes an opposite side or direction. The term "inner" or "inward" will be used to denote a location closer to a vertical center axis of the apparatus 10, while the terms "outer" or "outward" will denote a location further away from that center axis.

A rear planar surface of one of the right shock absorbing member 42 (the upper edge of this surface being shown at 44) is fixedly connected to an intermediate plate 46 that is in turn fixedly connected to the right side plate 38. The inner planar surface (the upper edge of which is indicated at 48) of the shock absorbing member 42 is not connected to the gusset plate 40. The second connection of the shock absorber 42 is to the aforementioned intermediate section 28, and this is at the surface (the upper edge of which is indicated at 50 relative to the left-hand shock absorbing member 42) which surface 50 is oppositely disposed to the surface 48.

The aforementioned intermediate section 28 comprises a middle portion 52 and two end portions 54. The middle section 52 comprises front and rear vertically and longitudinally aligned metal plates 56 and 58, respectively, which are fixedly connected by their outer edges to inner plates 60 of the end portions 54.

Each end portion 54 has a box like configuration, each of which comprises the aforementioned inner wall 60, an outer wall 62, and two side walls 64 and 66. It will be noted that the side wall 64 of the right hand intermediate section portion 54 is at a rear location while the corresponding wall 64 of the left intermediate section portion 54 is at a front location. In like manner, the wall 66 of the right end portion 54 is at a front location, while the corresponding wall 66 of the left-hand portion 54 is at a rear location.

The surface portion 50 of each of the shock absorbing blocks 42 is fixedly connected to a joining plate 68 which fits against and is fixedly connected to the aforementioned side wall 66. Thus, it becomes apparent that the two shock absorbing blocks or members 42 make a connection between the base section 24 and the intermediate section 28 by means of the surface 44 being fixedly attached to the plates 46 and 38 of the base section 24, while the opposite surface 50 of each of the shock absorbing members 42 is fixedly connected to the plate 68 and the plate 66 of the intermediate section 28.

The aforementioned front and rear intermediate plates 56 and 58 are connected through the second shock absorbing means 32 to the aforementioned connecting section 26. More specifically, there is a front set of eight cylindrical rubber like shock absorbing members 70, with the axis of each cylinder being horizontally aligned along a transverse axis. The front face 72 of each of these cylindrical shock absorbing members 70 is fixedly connected to the front plate 56, while the rear surface 74 of each of these shock absorbing members 70 is fixedly connected to a main center plate 76 which is part of the connecting section 26. As shown herein, these eight forward shock absorbing members 70 are disposed in two horizontal rows, with four upper shock absorbing members 70 being positioned directly above the bottom row of shock absorbing members 70.

In like manner, there is a rear set of eight cylindrical shock absorbing members 78 which extend between the rear intermediate plate 58 and the main center plate 76, with these shock absorbing members 78 being fixedly connected to the plates 58 and 76.

To describe now the connecting section 26, the aforementioned main center plate 76 is vertically and longitudinally aligned, and fixedly connected to its upper edge is a connecting ring 80 having a reinforcing sleeve 82 positioned therein. This connecting ring 80 attaches to the aforementioned cable 12.

From the foregoing description, it is apparent that the base section 24 can move vertically relative to the intermediate section 28, with the first shock absorbing members 42 yieldingly resisting such vertical movement. Further, it is also apparent that the connecting section 26 can move vertically relative to the intermediate section 28 with this vertical movement being yieldingly resisted by the shock absorbing means 32, and more specifically by means of the two sets of shock absorbing members 70 and 78.

Figure 4:
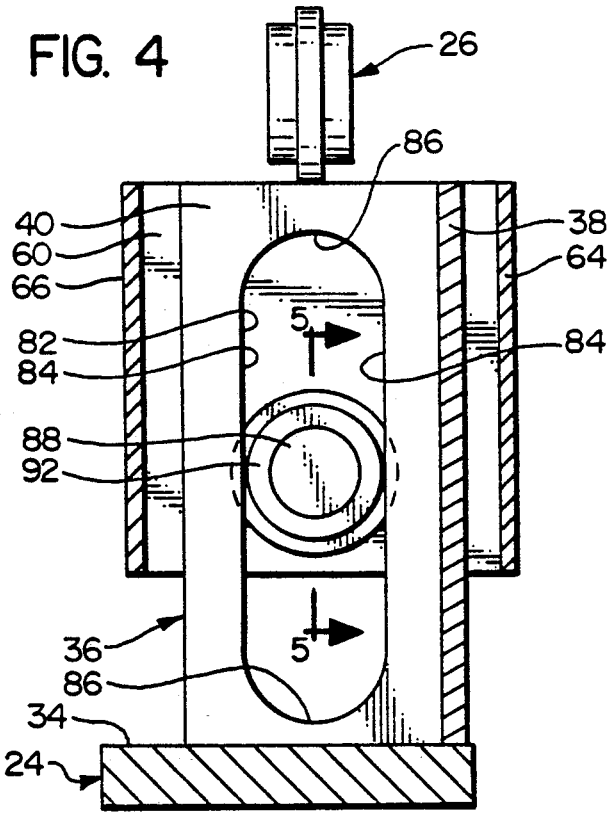
FIG. 4 is a sectional view taken along line 4—4 of FIG. 2.
Figure 5:
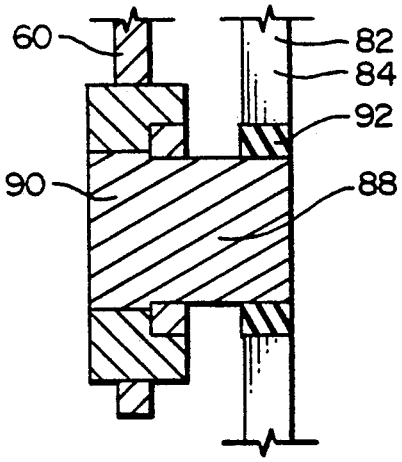
FIG. 5 is a sectional view taken along line 5—5 of FIG. 4.

In order to provide upper and lower limits between the relative vertical motion of the base section 24 and the intermediate section 28, there is provided a limit mechanism which is best illustrated in FIGS. 4 and 5. Each of the aforementioned gusset plates 40 is formed with a vertically aligned slot like opening 82 having straight vertical side surfaces 84 and upper and lower semicircular end surfaces 86. Each of the plates 60 has fixedly attached thereto a longitudinally and outwardly protruding cylindrical stop member 88 which is mounted by its inner end 90 to its related plate 60 and has at its outer end a mounting ring 92 (desirably made from a hard rubber or other moderately resilient material) that fits within the aforementioned slot 82. It is apparent that relative vertical motion between the base section 24 and the intermediate section 28 will cause a corresponding vertical motion of the stop member 92 relative to the slot 82.

To describe the operation of the present invention, let it be assumed that the shock absorbing apparatus 10 is in its operating position, as shown in FIG. 1, where the cable 12 is attached to the connecting ring 80, and the vibratory machine 16 is fixedly attached to the base plate 34. Let it be assumed that the jaws 18 of the vibratory machine 16 are fixedly secured to the piling 20, and that the cable 12 is under tension so as to pull the piling 20 out of the ground. Let it further be assumed that the force needed to pull the pile 20 out of the ground is relatively small (e.g., about two tons or more).

As mentioned previously, the shock absorbing members 70 and 78 are relatively stiff, and therefore will allow little relative movement between the connecting section 26 and the intermediate section 28 under a moderate load. On the other hand, the two relatively large shock absorbing blocks 42 are more yielding and will permit substantially greater deflection between the base section 24 and the intermediate section 28 for a given vertical load in comparison with the amount of vertical displacement between the connecting section 26 and intermediate section 28 for that same load.

As the tension is placed on the cable 12, the middle main plate 76 will be pulled upwardly, and the entire intermediate section 28 will also be moved vertically with very little relative movement between the main central plate 76 and the front and rear intermediate plates 56 and 58. On the other hand, the entire intermediate section 28 will move upwardly to a much greater extent relative to the base plate 34 which is fixedly secured to the vibratory machine 16. This will cause each of the main shock absorbing blocks 42 to distort so as to assume a general configuration of a parallelogram. At the same time, the two stop members 88 will be moved upwardly in their related slots 82 to some intermediate position. When the machine 16 begins its vibrating motion, the vibrations will be transmitted into the base plate 34 causing relatively rapid up and down vibratory movement of this plate 34. At this time (i.e., under relatively moderate tension loading of the cable 12), there will be very little up and down vibratory movement of the intermediate section 28. Thus, most of the shock absorbing function will be performed by the first more yielding shock absorbing means 30 which comprises the two large shock absorbing blocks 42.

Let it now be assumed that it is the desire to pull a pile 20 out of the ground, and a substantially larger tension force is required to accomplish this task (e.g., up to as high as one hundred tons). Under these circumstances, the tension force on the cable 12 will be sufficiently great so that the two shock absorbing members 42 will distort to the extent that the two stop members 88 will move to the upper limit of the slots 82 so that the bearing ring 92 will bear against the upper semi-circular stop surface 86. Under these circumstances, the up and down vibratory movement of the base plate 34 will be transmitted through the base end sections 36 directly to the intermediate section 28 so that this section 28 moves up and down with substantially the same vibratory motion as the plate 34. Under these circumstances, the shock loads are absorbed primarily in the second shock absorbing means 32 (i.e., the two sets of shock absorbing members 70 and 78). Since these shock absorbing members 70 and 78 are less yielding, these are better adapted to properly absorb these shock loads.

It is apparent that the dynamic characteristics of each of these shock means 30 and 32 must be designed to match the characteristics of the components with which these are to operate, and also to match the expected force loads which are to be encountered. Since this is well within the state of the art, these considerations will not be discussed in detail at this time.

It is to be understood that various modifications could be made to the present invention without departing from the basic teachings thereof.

What is claimed is:

1. A shock absorbing apparatus adapted to be connected between a pile driving and/or pile pulling vibratory device which generates a vibratory force and imparts the vibratory force to a pile and a carrying member for supporting the vibratory device, comprising:

a. a base section to be connected to the vibratory device;

b. a connecting section to be connected to a carrying member, where tension loads are applied to the base section and the connection section which cause a relative displacement therebetween;

c. an intermediate section;

d. first shock absorbing means operatively connected between the base section and the intermediate section for absorbing the vibratory force generated by the vibratory device, where the first shock absorbing means allows relative displacement between the base section and the intermediate sections.

e. second shock absorbing means operatively connected between the intermediate section and the connecting section for absorbing the vibratory force generated by the vibrating device where the second shock absorbing means allows relative displacement between the intermediate section and the connecting section; and f. stop means for so limiting relative movement between the intermediate section and one of the base and connecting sections that, above a predetermined tension load, the intermediate section does not move relative to the one of the base and connecting sections.

2. The apparatus as recited in claim 1, in which the shock absorbing capacity of the first and second shock absorbing means is different.

3. The apparatus as recited in claim 1, in which the vibratory force is absorbed primarily by one of the shock absorbing means at relatively smaller loads and primarily by the other of the shock absorbing means at relatively larger loads.

4. The apparatus as defined in claim 1, in which the stop means so limits relative movement between the intermediate and one of the base and connecting sections that, under the predetermined tension load, the sections between which the stop means limits relative movement come into contact with each other.

5. The apparatus as defined in claim 1, in which the intermediate section defines a center cavity and first and second end cavities, where:

the connecting section protrudes into the center cavity and the base section has first and second projections that protrude into the first and second end cavities, respectively;

the first shock absorbing means comprises first and second rectangular solid rubber shock absorbing members, where the first rectangular solid shock absorbing member extends from an inner wall of the intermediate section to the first projection and the second rectangular solid shock absorbing member extends from an inner wall of the intermediate section to the second projection: and the second shock absorbing means comprises a plurality of cylindrical rubber shock absorbing members that extend from inner walls of the intermediate section to the connecting section.

6. The apparatus as defined in claim 5, in which the vibratory force is absorbed primarily by the first shock absorbing means at relatively smaller loads and primarily by the second shock absorbing means at relatively larger loads.

7. The apparatus as recited in claim 1, in which the stop means comprises a slot formed in each of the projections and a stop member extending from each end of the intermediate section into one of the slots, where, under the predetermined load, the stop member so contacts the ends of the slot that the vibrating motion generated by the vibratory device is primarily absorbed by the second shock absorbing means.

8. The apparatus as recited in claim 7, in which a resilient mounting ring surrounds at least the portion of the stop member that extends into the slot.

9. The apparatus as recited in claim 8, in which one of the first and second rectangular solid shock absorbing members extends from an inner back wall of the intermediate section to the projection associated therewith and the other of the first and second rectangular solid shock absorbing members extends from an inner front wall of the intermediate section to the projection associated therewith.

* * * * *